US009771751B2

(12) United States Patent
Ibsies

(10) Patent No.: US 9,771,751 B2
(45) Date of Patent: Sep. 26, 2017

(54) HINGE DEVICE FOR AN AUTOMATED DOOR

(71) Applicant: Fadi Ibsies, Tigard, OR (US)

(72) Inventor: Fadi Ibsies, Tigard, OR (US)

( * ) Notice: Subject to any disclaimer, the term of this patent is extended or adjusted under 35 U.S.C. 154(b) by 0 days.

(21) Appl. No.: 14/242,376

(22) Filed: Apr. 1, 2014

(65) Prior Publication Data

US 2016/0340956 A1 Nov. 24, 2016

(51) Int. Cl.

| | |
|---|---|
| ***E05F 15/614*** | (2015.01) |
| ***E05F 1/06*** | (2006.01) |
| ***E05D 3/02*** | (2006.01) |
| *E05F 15/73* | (2015.01) |

(52) U.S. Cl.

CPC ..... *E05F 15/614* (2015.01); *E05D 3/02* (2013.01); *E05F 1/066* (2013.01); *E05F 2015/765* (2015.01); *E05Y 2800/11* (2013.01); *E05Y 2900/112* (2013.01); *Y10T 16/535* (2015.01)

(58) Field of Classification Search

CPC ... E05F 3/222; E05F 15/73; E05F 3/20; E05F 1/002; E05F 15/614; E05F 1/066; E05F 2015/765; E05D 5/12; E05D 5/16; E05D 3/02; E05D 5/04; E05D 3/122; E05Y 2400/10; E05Y 2900/112; E05Y 2400/44; E05Y 2800/11; Y10T 16/541; Y10T 16/535; Y10T 16/2771; Y10T 16/304

USPC ..... 16/354, 254, 54, 50, 387; 49/31, 107

See application file for complete search history.

(56) References Cited

U.S. PATENT DOCUMENTS

| | | | | |
|---|---|---|---|---|
| 5,878,530 | A * | 3/1999 | Eccleston et al. | E05F 15/79 49/139 |
| 6,108,975 | A * | 8/2000 | Bailey | E05F 15/63 49/334 |
| 7,068,179 | B2 | 6/2006 | Snell et al. | |
| 7,805,810 | B2 * | 10/2010 | Hoffman | E05D 3/127 16/354 |
| 7,971,316 | B2 * | 7/2011 | Copeland, II et al. | E05F 3/12 16/79 |
| 8,284,018 | B2 | 10/2012 | Ibsies | |
| 8,390,219 | B2 * | 3/2013 | Houser | E05F 15/70 318/255 |
| 8,407,937 | B2 * | 4/2013 | Houser | E05F 15/63 49/139 |
| 2005/0073425 | A1 * | 4/2005 | Snell et al. | E05F 15/00 340/686.6 |

* cited by examiner

*Primary Examiner* — William Miller

(74) *Attorney, Agent, or Firm* — Law Office of Karen Dana Oster, LLC

(57) ABSTRACT

The present invention includes three off-set hinges adapted to utilize the weight of the door to cause the door to self position and allow manual operation of the door. A center hinge includes a top leaf, a center pin, and a bottom leaf. The center pin includes an upper pin-portion adapted to slidably insert into an inverted slot on a top socket of the top leaf and an oppositely disposed lower pin-portion adapted to slidably insert into an upright cylindrical slot of the bottom leaf. A gear is disposed intermediate to the upper pin-portion and lower pin-portion. The gear is fixed or otherwise coupled to the pin whereby rotation of the gear results in corresponding rotation of the pin including both the top portion and the bottom portion. The lower pin-portion further includes a beveled lower (distal) end. This bevel matches a corresponding bevel in the bottom leaf.

12 Claims, 4 Drawing Sheets

HINGE DEVICE FOR AN AUTOMATED DOOR

FIELD OF THE INVENTION

This invention relates to a hinge mechanism apparatus for automated doors and, more specifically, to a hinge mechanism for hands-free operation of a door.

BACKGROUND

Recently, many devices and systems have been introduced to automate and render "hands-free" various operating fixtures of public bathrooms. From simple foot operated garbage can lids to removal of entry doors, varied attempts to render public bathrooms hygienic and eliminate hand-contact with fixtures has been limited to on-off, start-stop, or open-close operations of traditional facilities.

One attempt to provide a hands-free door-opening apparatus, described by Snell et al. in U.S. Pat. No. 7,068,179 on 27 Jun. 2006, includes an apparatus for automatically opening a swinging restroom door. It comprises an actuator, a control unit, and a power assisted drive mechanism and proximity sensor. This apparatus is applied to an exit/entry door to a bathroom and is not adapted for use on a stall-door and a patron waves his or her hand within the detection zone of the proximity sensor, this movement activates the door to open. Snell, however, does not contemplate adapting the apparatus for a stall-door, which typically is a much lighter door and lacks the physical space requirements for his apparatus. Further, not contemplated by Snell is the need for locking the enclosed area door when occupied by a patron and indicating to waiting patrons that the enclosed area is occupied.

Other attempts at hands-free operation of other bathroom fixtures include providing a sensor coupled to an activation mechanism whereby motion of a patron's hand within the proximity sensor's range causes towels to dispense from automated paper-towel dispensers, turns on a stream of water from a faucet, dollops a pre-determined amount of soap from a soap dispenser, or begins a time cycle activation of a heated hand dryer, for example. Motion sensors are also used to automate toilette flushing.

The inventor of the invention disclosed herein previously improved automated doors with an Automated Bathroom-Stall Door as described in U.S. Pat. No. 8,284,018 (issued on 2012 Nov. 9 to Ibsies). This reference describes a method and device that successfully operates and locks "hands-free" an enclosed area door. However, upon further reflection this inventor realized that further improvements could be made to further reduce the power needed to open such an automated door by improving the hinge mechanism.

DRAWING

DESCRIPTION OF THE INVENTION

Figure 2:
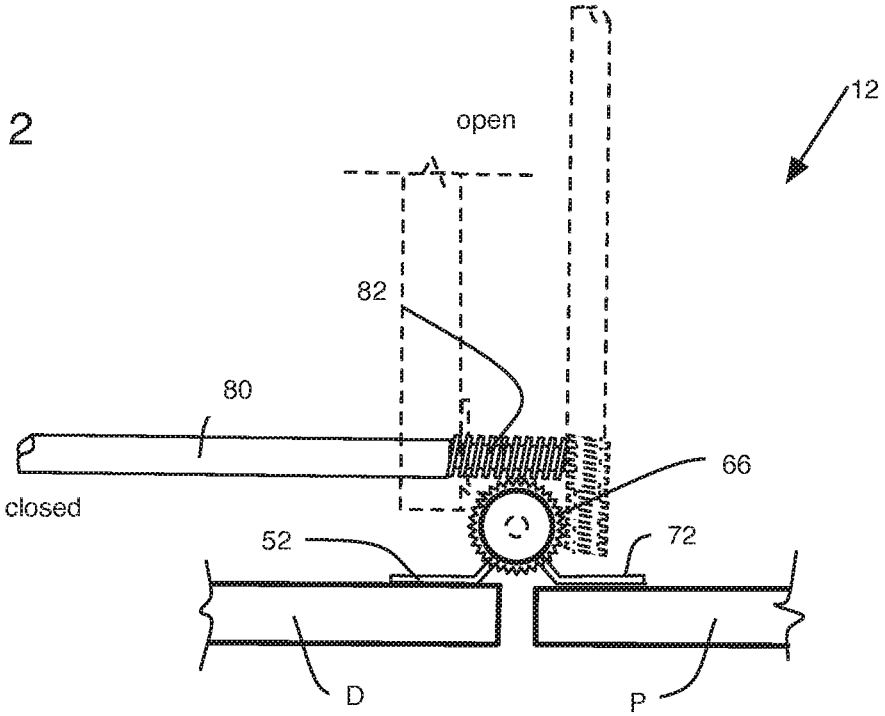
FIG. 2 is a partial top view of a center hinge according to one preferred embodiment of the present invention.
Figure 1:
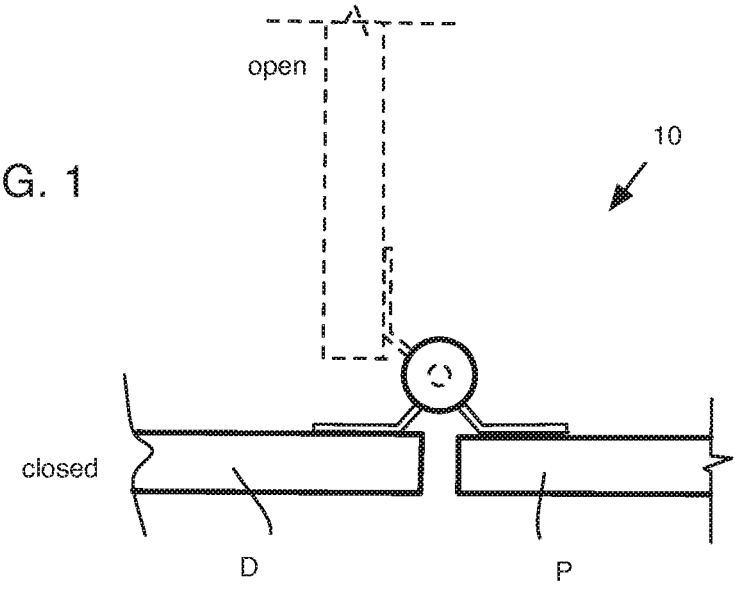
FIG. 1 is a partial top view of a top hinge according to one preferred embodiment of the present invention.
Figure 3:
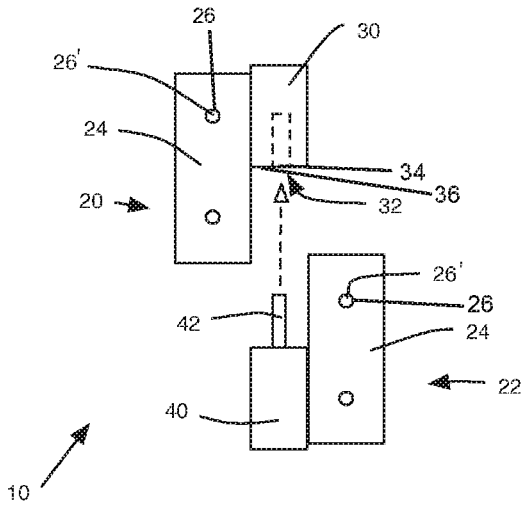
FIG. 3 is a front view of the top hinge of FIG. 1.
Figure 4:
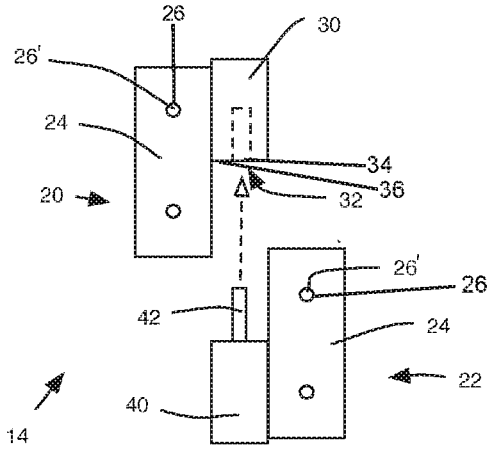
FIG. 4 is a front view of a bottom hinge according to one preferred embodiment of the present invention.
Figure 5:
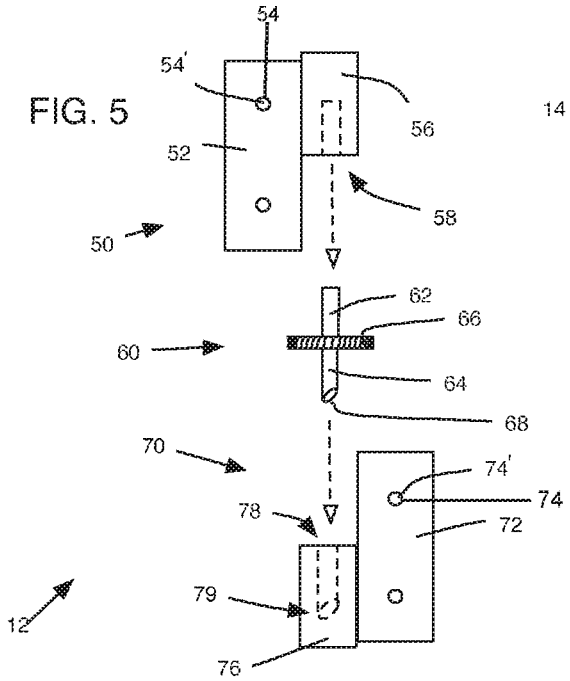
FIG. 5 is an exploded assembly view of the center hinge of FIG. 2.
Figure 6:
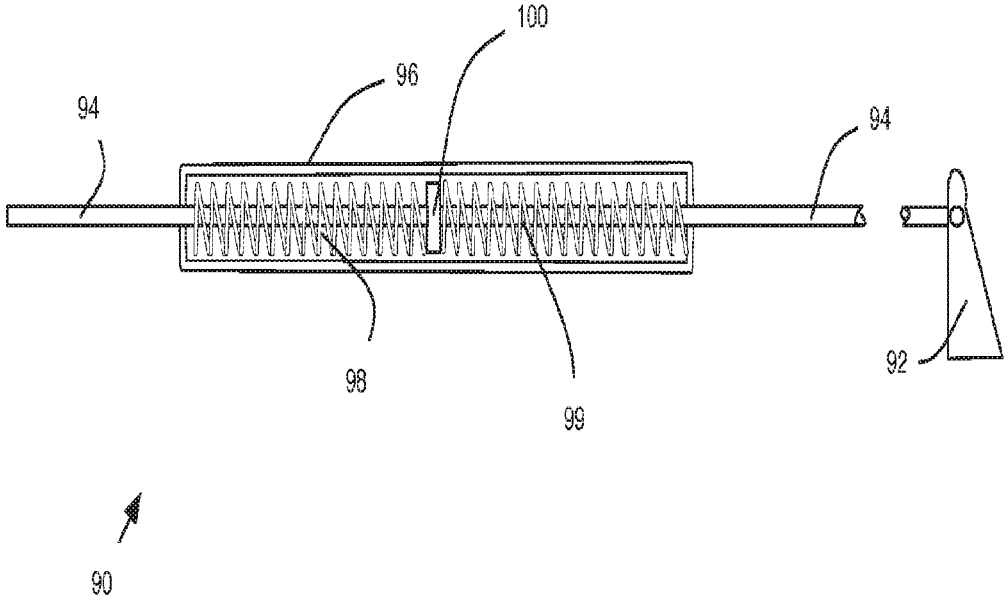
FIG. 6 is a top view of a rod assembly component of one embodiment of the present invention.

Possible preferred embodiments will now be described with reference to the drawings and those skilled in the art will understand that alternative configurations and combinations of components may be substituted without subtracting from the invention. Also, in some figures certain components are omitted to more clearly illustrate the invention.

The present invention relates to an improved hinge mechanism device that enables a "hands-free" automated door opening system as described in U.S. Pat. No. 8,284,018 to operate more easily, and to use less power, and yet still allow manual opening of a bathroom stall door, for example. The entire disclosure of U.S. Pat. No. 8,284,018 is hereby incorporated by reference as if fully set out herein.

One limitation of an automated bathroom stall door as described in U.S. Pat. No. 8,284,018 is the ability of the automated system to allow manual operation of the door without damaging the automated mechanism. The present invention, accordingly, improves upon the automated system by incorporating a novel arrangement of unique off-set hinge mechanisms that work in concert with this automated door opening system, as detailed below. Moreover, the present invention is well suited for use with portable bathrooms, or conventional bathroom stalls as used in public restrooms in, for example, schools, shopping malls, locker rooms, hospitals, etc.

Improved Hinge Mechanism

The present invention includes three off-set hinges adapted and configured to work in harmony to utilize the weight of the door to cause the door to self position (i.e. self close), and further allow manual over-ride operation of the door (i.e. a patron pushing open or pulling closed the door) without damaging the automated components (the automated components are further described, below). Adding or replacing the conventional center-mount pivot-hinge found in most conventional bathroom stall door scenarios, and replacing any piano mount hinges in other conventional bathroom stall door applications, the present invention utilizes three offset hinges, each with a unique configuration. The three hinges are referred to as the top hinge 10, center hinge 12, and bottom hinge 14, and are further detailed in the following paragraphs.

Top and Bottom Hinges

Both the top 10 and bottom 14 hinges operate and are otherwise configured similarly. Making specific reference to the top hinge: The top hinge consists of a door-side leaf 20 and a panel-side leaf 22. Each leaf includes a relatively flat, rectangular body 24 area with two or more through holes 26 traveling through the body. The through holes 26 are configured to receive common fasteners 26'. The common fasteners couple the corresponding leaf to the structure of the door D or fixed panel P, as appropriate.

The door-side leaf 20 further includes an upper shoulder 30 portion that defines a cylindrical slot 32 with a circular opening 34 on a bottom face 36 of the shoulder portion. The opening 34 and the slot 32 are configured to slidably receive a pin 42 from the panel-side leaf 22.

The panel-side leaf 22 includes a corresponding lower shoulder portion 40 carrying an upward extending cylindrical pin 42, which is configured to insert into the cylindrical slot 32 of the upper shoulder 30.

The bottom hinge 14 is configured identically to the top hinge; a detailed recitation of the bottom hinge is omitted for brevity. However, those skilled in the art will appreciate its form, function, configuration, and operation are identical to that of the upper hinge just described above.

Center Hinge

The center hinge 12 consists of three primary components: a top leaf 50, a center pin 60, and a bottom leaf 70.

The top leaf 50 includes a substantially flat and rectilinear leaf body 52 having two or more through holes 54, which are configured to enable conventional fasteners 54' to attach the top leaf to the door D. The top leaf further includes a top socket 56 that defines an inverted cylindrical slot 58 with a circular opening on a bottom surface of the top socket.

The bottom leaf 70 includes a substantially flat and rectilinear leaf body 72 having two or more through holes 74, which are configured to enable conventional fasteners 74' to attach the bottom leaf to the fixed panel P. The bottom leaf further includes a bottom socket 76 that defines an upright cylindrical slot 78 with a circular opening on a top surface of the bottom socket. This upright cylindrical slot further includes a specifically oriented beveled bottom wall 79.

The center pin 60 is configured to include an upper pin-portion 62 adapted to slidably insert into the inverted cylindrical slot 78 of the top socket 76 and an oppositely disposed lower pin-portion 64 adapted to slidably insert into the upright cylindrical slot 78 of the bottom socket 76. A gear 66 is disposed intermediate to the upper pin-portion and lower pin-portion. The gear is fixed or otherwise coupled to the pin, whereby rotation of the gear results in corresponding rotation of the pin including both the top portion and bottom portion.

The lower pin-portion further includes a beveled lower (distal) end 68: This bevel 68 matches the bevel 79 of the bottom socket's upright cylindrical slot's bottom wall.

The upper pin-portion 62 is coupled to the inverted cylindrical slot 58 so that as the pin rotates the pin causes the door to rotate in a corresponding manner. And conversely, if the door rotates, the door causes the center pin to make a corresponding rotation. However, the lower pin-portion 64 is further configured to rotate freely in the bottom leaf 70.

In automated operation, the motor of the automated door (see below), through gears, transfers power to the pin gear, thus causing the center pin to rotate (open or closed as determined by the automated door motor assembly). The design of the cooperating bevels (lower socket and center pin) causes the pin to normally rest with the matching bevels in contact. So, when the motor engages the pin gear, the door moves from a first position (i.e. closed) to a second position (i.e. open), or vice versa. At a proximal end, the rod 80 includes a worm gear 82 that is configured to engage the gear 66 of the center hinge 60. The worm gear 82 is able to disengage from the gear 66 when the door is manually manipulated.

In manual operation, however, when a patron pushes open or pulls closed the door, the center pin, free to rotate on the bottom socket, twists, and therefore, rises upward out of the bevel portion of the bottom socket. The rigid coupling of the center pin's upper pin-portion to the top socket forces the entire door upward. As the top and bottom hinges include free-sliding pins, the entire door is free to move upward and thus remove the center gear from the transmission gear of the motor assembly, thus preventing stripped gears.

Further, the weighting of the door combined with the cooperating three hinges as just described, causes the door to return to the first (closed) position after a patron manually pushes (from inside the stall) or pulls (from outside the stall) the door open (second position).

The Automated Door Opening System.

Figure 7:
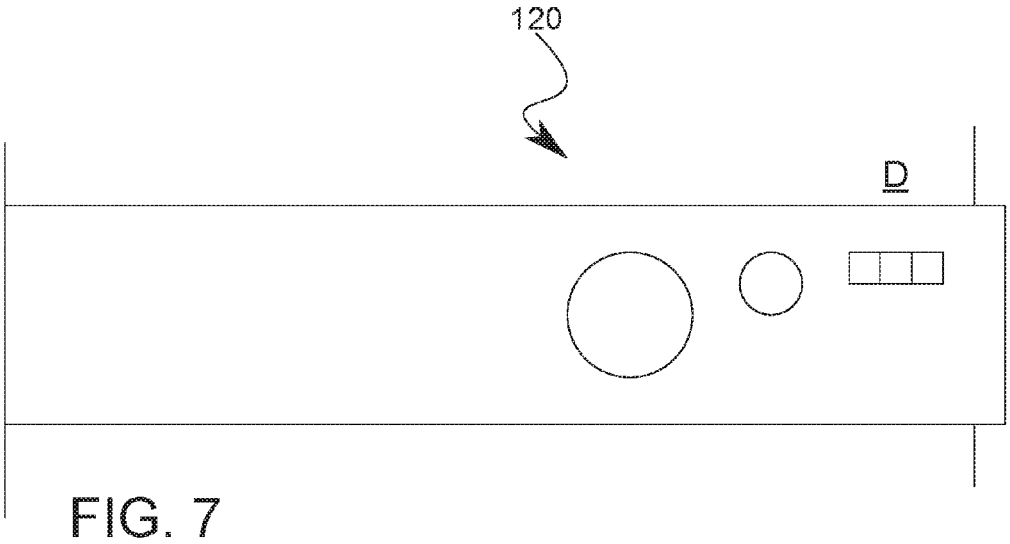
FIG. 7 shows a first face of a hand-free operation module with proximity sensors and LED indicators.
Figure 8:
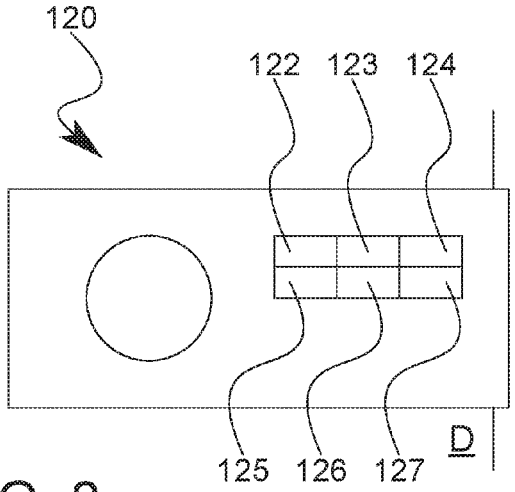
FIG. 8 shows a second face of a hands-free operation module with proximity sensors and LED indicators.

As in U.S. Pat. No. 8,284,018, the present invention enables hands-free operation of a door from inside or outside and includes manual override from both sides. FIGS. 7 and 8 show a first face and a second face, respectively, of a hands-free operation module 120 with proximity sensors 122, 123, 124, and LED indicators 125, 126, and 127. To prevent unintended opening of the stall-door the present invention includes at least one sensor to determine if the restroom enclosed area is occupied. This sensor, in other contemplated embodiments, is a proximity sensor coupled to an image processor that is programmed to "see" whether space, such as a bathroom stall, or other enclosed area, is occupied. The determination of whether an enclosed area is occupied is a first condition, which will be further discussed below.

In addition, the present invention contemplates a stand-alone locking mechanism for retrofitting to existing power-actuated doors. It will be appreciated and understood by those skilled in this art that the invention described herein can be adapted for use on any such door where "hands-free" opening of the door and locking/unlocking of the door is desired. To avoid unwanted locking, unlocking, or opening of a door, a particular gesture is pre-programmed and predetermined. Any gesture is possible, however, care must be taken to avoid gestures that might appear to the proximity sensor similar to linear movement from, for example, someone simply walking past the proximity sensor. Thus, a wave or circular hand motion may be desired to be incorporated in the predetermined gesture. The predetermined gestures can be represented on an instruction panel displayed on the door, for example.

Accordingly, the improved apparatus for automatically opening, closing, locking, and unlocking a swinging door includes a first actuator and power-assisted drive mechanism for opening and closing the door and a second actuator and associated power-assisted drive mechanism for locking and unlocking the door, a control unit, a power source (either on-board or remote) and a plurality of sensor units. It is further contemplated that the mechanism for opening the door and the mechanism for locking the door could be combined into one mechanism. In one embodiment these are separate mechanisms, and both power drive mechanisms include a corresponding limit unit in communication with the mechanical components for opening and locking the enclosed area door so that manual operation can be affected without damage to the automatic components.

To operate the improved apparatus for automatically opening, closing, locking, and unlocking a swinging door in a hands-free mode, first, an interior sensor must sense that the enclosed area is unoccupied (a second condition). The apparatus indicates an unoccupied status by illuminating an LED indicator on the exterior of the door. Then, the patron places a hand in front of the left-most proximity first proximity sensor on the exterior side of the door, and then moves the hand in a predetermined pattern or gesture. The first proximity sensor reads this pattern, which is in communication with a processor that then interprets the series of images streamed from the first proximity sensor. If the gesture made by the user matches the predetermined pattern, an indicator light will glow solid green. The processor then commands the door-opening/closing drive mechanism to open the door.

Once the patron is inside the enclosure accessed by the door, a second proximity sensor captures the gesture made by the user. Again, a predetermined pattern read by the second proximity sensor by means of the processor, signals actuators that close the door. With the door closed and enclosure occupied, an indicator on the exterior of the door indicates that the enclosure is occupied, for example, by displaying a solid red color or a sign that illuminates or otherwise indicates "occupied." A corresponding indicator on the inside of the enclosure also illuminates to show the user what the status indicator on the outside shows.

To unlock and exit the enclosure, the patron waves the hand in a predetermined gesture pattern, which is read by the proximity sensor and processed by the processor and the door unlocks and opens.

To assist operation with seeing-impaired patrons, an audible signal may be used to augment the illuminated LED indicators and to indicate registration of the swiping hand movement in front of the respective sequence of proximity sensors. The controller can be programmable to vary options of opening, closing, locking an unlocking. For example, the controller can be programmed to ignore commands to lock the enclosed area door, or can be programmed to automatically lock the door upon receiving a "close door" sequence from the interior proximity sensors. Similarly, to unlock the door, the controller can be programmed to require a first and second swipe past the proximity sensors. The direction and duration of the swipe may be programmed as required to enable full customization of the apparatus.

In one preferred embodiment, a low-power apparatus is contemplated wherein on-board storage cells (batteries) draw current from ambient light from a solar panel on the door or connected to the apparatus. The batteries provide sufficient power to run the two actuators for opening/closing and locking/unlocking. In this manner, the apparatus is a self-contained unit that can be retrofitted to existing enclosed area doors that use simple hinges (lacking any opening mechanism) and gravity to operate.

For example, a conventional restroom enclosed area door is relatively light-weight and is attached to the adjoining stall-wall by a top and bottom hinge element. The weight of the door does not require a supplemental mechanism to assist opening or closing. The existing enclosed area door is simply pulled or pushed open or closed. The present invention readily adapts to the conventional enclosed area door and comprises an outer housing with a rigid shell and a variable shell adapted to fit varying widths of enclosed area doors. There is an exterior side and interior side of the housing corresponding to the orientation of the apparatus on an enclosed area door. This housing consists of a lightweight metal (such as aluminum or stainless steel) or tough plastic (such as ABS) material or other similar material common to commercial rest-room construction as would be well-understood in this art. The housing protects the various components from vandalism and unintentional damage from use in high-volume public restrooms.

A preferred embodiment of the present invention includes a hands-free operation module for the enclosed area door, of which a portion is mounted on the interior face of the door. This interior portion of the module includes a housing, at least a portion of which is a rigid shell segment or a plurality of overlapping segments to accommodate varying widths of enclosed area doors.

The exterior face of the bathroom stall doors includes a shell covering at least a portion of the exterior. The portion being sufficient to present a sensor and display to patrons.

A portion of the interior face of the enclosed area door includes a shell housing having a display and sensor array. The housing further covers and holds therein a controller (or preferably a processor) with power supply. This processor and power supply, naturally, can be two separate units, such as a solid-state logic board and separate battery pack coupled by electrical wires for transferring power to the board and further in electrical communication with the various components as would be understood by those skilled in this art.

The first proximity sensor faces outward and includes a display, such as an LED display array that consists of at least one light having a first and preferably a second color. Alternately, a series of LED indicator lights can be used to show different status conditions, such as occupied, available, and that the gesture is being interpreted or misinterpreted by the processor (i.e. a flashing green indicates that the gesture is correct, but a flashing red light indicates that the gesture is not being understood).

Both the interior portion and exterior portion of the invention include a manual override handle. On the inside of the stall, the shell includes a handle that mechanically connects to the lock pin and slides back and forth horizontally as the lock pin actuates from unlocked to locked and back. The handle is sufficiently large to allow a patron to grab hold and slide the lock in the direction desired and pull or push the door to the desired open or closed position. On the exterior face, a handle includes a key lock to isolate the handle from movement to prevent unwanted operation of the lock mechanism. However, in emergency or other situations, the restroom management can insert a key to enable exterior manual opening/closing/locking/unlocking of the enclosed area door.

Also included on the interior portion of the shell, an occupied-sensor determines whether the enclosed area is occupied by a patron. If so, a signal is sent to the controller causing the exterior LED to illuminate an occupied sequence (i.e. three red lights, or illuminating a back-lit text stating "occupied," or other known means of communicating that the enclosed area is in use by a patron). Conversely, the same sensor, detecting that the enclosed area is unoccupied, signals the controller to display a "vacant" signal to the exterior display.

There is also an inward facing proximity sensor or other sensor, its operation and configuration being very similar to those of the outward facing proximity sensor. The inside portion of the door may also include one or more indicator lights, as previously explained.

Not shown in the drawing, however, as would be well-understood by those in this art, the conventional lock mechanism for enclosed area doors typically comprises a simple bolt pin that slides or extends horizontally from an open position to a closed position. In the closed position, a cooperating mechanical fixture mounted to the stationary wall-portion of the enclosed area receives a portion of the bolt pin, which prevents the door from swinging open. This is a very simple and effective design. The present invention includes an electro-magnet that, when charged, magnetically couples to the traditional lock pin, or a pin that is substantially similar in operation. So energized, the controller can then signal an actuator to move from a first position to a second position and thereby draw, by the magnetic coupling, the pin open. Simple mechanical transfer of motion is used to push the pin into the locked position.

Because enclosed area doors are relatively light-weight (compared to conventional doors), a simple opening mechanism and low-power motor is all that is needed to open the door. A simple DC motor coupled to a gear set enables forward or reverse rotation of the motor spindle gear. This rotary motion is distributed through a gear-set to the door-opening gear, which meshes with a similar gear on the door. To reduce the relative high-speed rotation of the motor at gear, a series of reduction gears disposed intermediate transfers the vertical-axis rotation to horizontal axis rotation and simultaneously reduces the speed to open and close the enclosed area door coupled to gear.

Other embodiments of the door-opening system include stand-alone devices or accessories working with the aforementioned automated door opener for various public restroom stall door latch and locking devices. Such a stand-alone or accessory unit covers the locking mechanism and carries its own power supply and sensor array to unlock the stall door. Common locks include a rotary style, or a sliding latch, or a lock integrated into the door handle. This latter-type of lock prevents the latch bolt from retracting and the handle/lever from rotating when in the locked position. Often this type of lock mechanism has a push-button that activates the lock mechanism. The present invention, in one embodiment, contemplates a device that overlays a portion of the handle and rose and replaces the push button with an automated door locking system that mechanically interfaces with the latch bolt and is activated by motion sensing proximity sensors as described above.

Latch Mechanism

As described above, when an open condition is detected, the motor assembly opens the door. This opening consists of activating a DC motor to turn, which in turn drives transmission gears that transfer this rotation to a rod assembly 90, moving the entire rod assembly, which at a distal end couples to an arm and pivot 92 that couples to the door.

To enable manual operation of the door without damaging the motor, transmission, and gears, the rod assembly consists of an inner rod 94, outer tube 96, and compression spring. If the door is manually operated, the inner rod moves relative to the other tube compressing one of two compression springs (depending on the direction door is being manually operated). When manual pressure is removed from the door, the compression spring rebounds, thus driving the inner rod back to its original position.

A stop 100 couples to the inner rod and is disposed at an intermediate location on the inner rod with respect to the other tube 96. A first compression spring 98 rests on one side of the stop and second compression spring 99 arranges on the opposite side of the stop. The stop and both compression springs are encapsulated by the outer tube. The outer tube allows the inner rod to slidably move, but the opposite ends of the outer tube are partially closed to prevent the compression springs from escaping.

Additional Components

To further enable hands-free operation of bathroom stall doors and portable bathroom doors, a foot pull device mounts to a lower portion of the door at an end opposite the hinged edge of the door. The foot pull includes an L-shaped or U-shaped extension that configures to enable a user to push open or pull closed the door with the user's foot.

Another aspect of the present invention is the use of a latch handle that operates by means of a solenoid when a condition is such to indicate that the door should be latched or unlatched, but can also be over-ridden manually enabling the user of the bathroom to simply unlatch the door in a conventional manner.

Yet another aspect of the contemplated invention is a sensor panel that couples (by gluing or screwing, for example) to the door and pulls power (either by wire or induction) from an existing power supply, such as the automated door actuator present on most power handicap bathroom doors.

Although the invention has been particularly shown and described with reference to certain embodiments, it will be understood by those skilled in the art that various changes in form and detail may be made without departing from the spirit and scope of the invention.

I claim:

1. A hinge mechanism device configured to couple to a door and a fixed panel, the device comprising:

(a) a top hinge coupled to the door and panel, the top hinge comprising a door-side leaf and a panel-side leaf, each leaf includes a relatively flat, rectangular body area with at least one through hole through the body:
  (i) the door-side leaf further comprises an upper shoulder portion that defines a cylindrical slot with a circular opening on a bottom face of the upper shoulder portion;
  (ii) the panel-side leaf comprises a corresponding lower shoulder portion carrying an upward extending cylindrical pin; and
  (iii) the upward extending cylindrical pin is configured to insert into the cylindrical slot of the upper shoulder portion;

(b) a center hinge comprising a top leaf, a center pin, and a bottom leaf wherein:
  (i) the top leaf comprises a substantially flat and rectilinear leaf body having at least one through hole, the at least one through hole configured to enable at least one fastener to attach the top leaf to the door, the top leaf further includes a top socket that defines an inverted cylindrical slot with a circular opening on a bottom surface of the top socket;
  (ii) the bottom leaf comprises a substantially flat and rectilinear leaf body having at least one through hole, the at least one through hole configured to enable at least one fastener to attach the bottom leaf to the fixed panel, the bottom leaf further comprises a bottom socket that defines an upright cylindrical slot with a circular opening on a top surface of the bottom socket, the upright cylindrical slot further includes a specifically oriented beveled bottom wall; and
  (iii) the center pin comprising:
    an upper pin-portion configured to slideably insert into the inverted cylindrical slot of the top socket;
    an oppositely disposed lower pin-portion adapted to slideably insert into the upright cylindrical slot of the bottom socket;
    a gear disposed intermediate to the upper pin-portion and lower pin-portion; and
    the lower pin-portion further comprises a beveled, lower distal end; and (c) further, the upper pin-portion is coupled to the inverted cylindrical slot so that as the center pin rotates the center pin causes the door to rotate in a corresponding manner and the lower pin-portion is further configured to rotate freely relative to the bottom leaf.

2. The device of claim 1 further comprising a bottom hinge configured to couple to the door and the fixed panel.

3. An improved hinge mechanism device for a door hingeably mounted to a panel, the door having an apparatus comprising at least one proximity sensor, the at least one proximity sensor on at least one side of the door, the improved hinge mechanism comprising:

(a) a top hinge coupled to the door and panel, the top hinge comprising a door-side leaf and a panel-side leaf, each leaf includes a relatively flat, rectangular body area with two or more through holes through the body:

(i) the door-side leaf further comprises an upper shoulder portion that defines a cylindrical slot with a circular opening on a bottom face of the upper shoulder portion;

(ii) the panel-side leaf comprises a corresponding lower shoulder portion carrying an upward extending cylindrical pin; and (iii) the upward extending cylindrical pin is configured to insert into the cylindrical slot of the upper shoulder portion;

(b) a center hinge comprising a top leaf, a center pin, and a bottom leaf wherein:

(i) the top leaf comprises a substantially flat and rectilinear leaf body having two or more through holes, the two or more through holes being configured to enable fasteners to attach the top leaf to the door, the top leaf further includes a top socket that defines an inverted cylindrical slot with a circular opening on a bottom surface of the top socket;

(ii) the bottom leaf comprises a substantially flat and rectilinear leaf body having two or more through holes, the two or more through holes being configured to enable fasteners to attach the bottom leaf to the fixed panel, the bottom leaf further comprises a bottom socket that defines an upright cylindrical slot with a circular opening on a top surface of the bottom socket, the upright cylindrical slot further includes a specifically oriented beveled bottom wall; and (iii) the center pin comprises:

an upper pin-portion configured to slideably insert into the inverted cylindrical slot of the top socket;

an oppositely disposed lower pin-portion adapted to slideably insert into the upright cylindrical slot of the bottom socket;

a gear disposed intermediate to the upper pin-portion and lower pin-portion; and the lower pin-portion further comprises a beveled, lower distal end; and (c) further, the upper pin-portion is coupled to the inverted cylindrical slot so that as the center pin rotates the center pin causes the door to rotate in a corresponding manner and the lower pin-portion is further configured to rotate freely relative to the bottom leaf.

4. The device of claim 3 further comprising a bottom hinge configured to couple to the door and the fixed panel.

5. The device of claim 3, the at least one proximity sensor is a proximity sensor array.

6. The device of claim 3, the at least one proximity sensor is a proximity sensor array having at least three linearly disposed sensors.

7. The device of claim 3, the at least one proximity sensor is a proximity sensor array having at least three linearly disposed sensors, each sensor further including a light-emitting diode display device.

8. A hinge configured to couple a door and a fixed panel, the hinge comprising:

(a) a top leaf attachable to the door, the top leaf further comprising a top socket that defines an inverted slot on a bottom surface of the top socket;

(b) a bottom leaf attachable to the fixed panel, the bottom leaf further comprising a bottom socket that defines an upright slot on a top surface of the bottom socket, the upright slot further includes a specifically oriented beveled bottom wall; and (c) a center pin comprising:

(i) an upper pin-portion configured to be insertable into the inverted slot of the top socket;

(ii) an oppositely disposed lower pin-portion adapted to be insertable into the upright slot of the bottom socket;

(iii) a gear disposed intermediate to the upper pin-portion and lower pin-portion; and (iv) the lower pin-portion further comprises a beveled, lower distal end;

(d) wherein the upper pin-portion is coupled to the inverted slot so that as the center pin rotates, the center pin causes the door to rotate in a corresponding manner and the lower pin-portion is further configured to rotate freely relative to the bottom leaf.

9. The hinge of claim 8 further comprising at least one secondary hinge having a door-side leaf and a panel-side leaf, the door-side leaf attachable to the door, and the panel-side leaf attachable to the panel, the at least one secondary hinge comprising:

(a) the door-side leaf further having an upper shoulder portion that defines a slot on a bottom face of the upper shoulder portion;

(b) the panel-side leaf having a lower shoulder portion carrying an upward-extending pin; and (c) the upward-extending pin is configured to insert into the slot of the upper shoulder portion.

10. The hinge of claim 8 wherein said inverted slot is an inverted cylindrical slot with a circular opening.

11. The hinge of claim 8 wherein said upright slot is an upright cylindrical slot with a circular opening.

12. The hinge of claim 8 wherein said inverted slot is an inverted cylindrical slot with a circular opening, and wherein said upright slot is an upright cylindrical slot with a circular opening.

* * * * *